US008438734B2

(12) United States Patent
Groszkiewicz et al.

(10) Patent No.: US 8,438,734 B2
(45) Date of Patent: May 14, 2013

(54) RAIL VEHICLE ASSEMBLY SYSTEM AND METHOD

(75) Inventors: Paul David Groszkiewicz, Lawrence Park, PA (US); Dale Soder, Lawrence Park, PA (US); Bruce Fenstermaker, Lawrence Park, PA (US)

(73) Assignee: General Electric Company, Schenectady, NY (US)

( * ) Notice: Subject to any disclaimer, the term of this patent is extended or adjusted under 35 U.S.C. 154(b) by 439 days.

(21) Appl. No.: 12/842,288

(22) Filed: Jul. 23, 2010

(65) Prior Publication Data

US 2012/0017411 A1 Jan. 26, 2012

(51) Int. Cl.
*B61F 5/00* (2006.01)
*B21D 39/03* (2006.01)

(52) U.S. Cl.
USPC ..... 29/897.2; 29/281.1; 105/157.1

(58) Field of Classification Search 254/93 R; 29/281.1, 29/407.08, 428–525.15, 897.2; 81/486
See application file for complete search history.

(56) References Cited

U.S. PATENT DOCUMENTS

| | | | | | |
|---|---|---|---|---|---|
| 1,411,027 | A | * | 3/1922 | Holy | 105/82 |
| 3,406,439 | A | * | 10/1968 | Hutchens | 29/897.2 |
| 3,778,079 | A | * | 12/1973 | Vornberger et al. | 280/149.2 |
| 3,908,559 | A | * | 9/1975 | Fromm | 105/453 |
| 4,040,360 | A | * | 8/1977 | Jackson | 105/136 |
| 4,040,361 | A | * | 8/1977 | Jackson | 105/136 |
| 4,793,047 | A | | 12/1988 | Curtis et al. | |
| 5,890,433 | A | * | 4/1999 | Wicks | 105/4.2 |
| 6,871,598 | B2 | | 3/2005 | Schaller et al. | |
| 7,328,659 | B2 | * | 2/2008 | Forbes | 105/198.2 |
| 7,954,436 | B2 | * | 6/2011 | Gorski et al. | 105/218.1 |
| 2009/0099714 | A1 | | 4/2009 | Kumar et al. | |
| 2010/0175580 | A1 | * | 7/2010 | Gorski et al. | 105/157.1 |
| 2010/0175581 | A1 | * | 7/2010 | Kumar et al. | 105/157.1 |
| 2011/0203480 | A1 | * | 8/2011 | Donnelly | 105/35 |
| 2011/0221159 | A1 | * | 9/2011 | Gorski et al. | 280/124.179 |

FOREIGN PATENT DOCUMENTS

| | | | | |
|---|---|---|---|---|
| JP | 2012086832 | A | * | 5/2012 |
| SU | 384712 | A | * | 6/1974 |

* cited by examiner

*Primary Examiner* — David Bryant
*Assistant Examiner* — Jacob Cigna
(74) *Attorney, Agent, or Firm* — GE Global Patent Operation; John A. Kramer

(57) ABSTRACT

There is provided a method for assembling a rail vehicle. The method includes positioning a plurality of motor combos on a fixture frame. The fixture frame may be adapted to hold each of the plurality of motor combos positioned for an assembly into a rail vehicle truck. The method further includes positioning a plurality of springs on each of the plurality of motor combos. The plurality of springs are positioned for the assembly into the rail vehicle truck. Additionally, the method includes simultaneously lifting a plurality of motors such that a truck frame may be coupled to the motors. The plurality of motors corresponds to the plurality of motor combos. The method also includes connecting the truck frame to the plurality of motors, attaching a spring compression fixture to the truck frame and the fixture frame, and compressing the plurality of springs for assembly into the rail vehicle truck.

15 Claims, 12 Drawing Sheets

300

RAIL VEHICLE ASSEMBLY SYSTEM AND METHOD

BACKGROUND

Exemplary embodiments of the invention relate generally to a system and method for assembling rail vehicles. Moreover, such exemplary embodiments may relate to improving the safety of rail vehicle assembly.

A locomotive is powered along rails by a locomotive truck, which includes the motor and wheels. The locomotive truck is actually an assembly of two to four motor combinations (combos) and springs, positioned beneath, and secured to, a truck frame.

Currently, when assembling a locomotive truck, the truck frame is flipped upside down, and the springs are moved into position on the truck frame. The motor combos may then be lowered onto the truck frame using a hoist. The motor combos are positioned over the springs as they are lowered onto the truck frame.

The springs are then compressed by placing a large weight (for example, a 28-ton weight) on top of the motor combos. Journal boxes (J-boxes), which contain bearings for drive wheels, are then secured to the frame, and the entire assembly, now weighing up to 32 tons, is flipped back over to its proper position.

The assembly of the truck can be a hazardous process because the large and heavy truck components are suspended in the air during two flipping operations. Further, the operators performing the assembly work in close proximity to the suspended components, putting them in harm's way if one or more of the components falls. Accordingly, an improved technique for assembling rail vehicles may be desirable.

BRIEF DESCRIPTION

Briefly, in accordance with an exemplary embodiment of the invention, there is provided a method for assembling a rail vehicle. The method includes positioning a plurality of motor combos on a fixture frame. The fixture frame may be adapted to hold each of the plurality of motor combos positioned for an assembly into a rail vehicle truck (e.g., a truck for a locomotive). The method further includes positioning a plurality of springs on each of the plurality of motor combos. The plurality of springs is positioned for the assembly into the rail vehicle truck. The method also includes connecting a truck frame to the plurality of motor combos, attaching a spring compression fixture to the truck frame and the fixture frame, and compressing the plurality of springs for assembly into the rail vehicle truck. In another embodiment, the method further comprises simultaneously lifting a plurality of motors such that the truck frame may be coupled to the motors. The plurality of motors corresponds to the plurality of motor combos, that is, each motor combo includes a respective one of the plurality of motors.

Another exemplary embodiment relates to a combo lifter device adapted to simultaneously lift a plurality of motors. The combo lifter device includes a plurality of segments, a connecting rod, and a hydraulic cylinder or other actuation device. Each of the segments includes a base, a lifter arm, and a connector. The connecting rod connects the plurality of segments at the connectors. The hydraulic cylinder or other actuation device is adapted to move the connecting rod. Moving the connecting rod simultaneously moves the lifter arms, wherein the lifter arms simultaneously lift the plurality of motors.

Another exemplary embodiment relates to a spring compression fixture device adapted to compress a plurality of springs for assembly into a rail vehicle truck (e.g., a truck for a locomotive). The spring compression fixture device includes a hydraulic cylinder or other actuation device that attaches to the fixture frame. (In one embodiment, the hydraulic cylinder or other actuation device temporarily attaches to the fixture frame.) The hydraulic cylinder or other actuation device is adapted to apply a pressure sufficient to compress the springs for the assembly into the rail vehicle truck. The spring compression fixture device also includes a top portion adapted to attach to the truck frame and the hydraulic cylinder or other actuation device. (In one embodiment, the top portion is attached to the hydraulic cylinder or other actuation device, and the top portion is adapted to temporarily attach to the truck frame.)

Another exemplary embodiment relates to a fixture frame device for assembling a rail vehicle truck (e.g., a truck for a locomotive). The fixture frame device includes a structure for positioning each of a plurality of motor combos relative to others of the motor combos for the assembly into the rail vehicle truck. The motor combos each include two wheels, an axle, a motor, and a plurality of journal bearing housings comprising a roller bearing for the axle. The fixture frame device further includes a plurality of structures for supporting the two wheels. Additionally, the fixture frame device includes a plurality of structures for supporting the plurality of journal bearing housings. The fixture frame device also includes a plurality of structures for supporting the motor for each of the plurality of motor combos. Further, the fixture frame device includes a plurality of openings for positioning a combo lifter that simultaneously lifts each of the motors.

DRAWINGS

These and other features, aspects, and advantages of embodiments of the invention will become better understood when the following detailed description is read with reference to the accompanying drawings in which like characters represent like parts throughout the drawings, wherein.

DETAILED DESCRIPTION

Figure 1A:
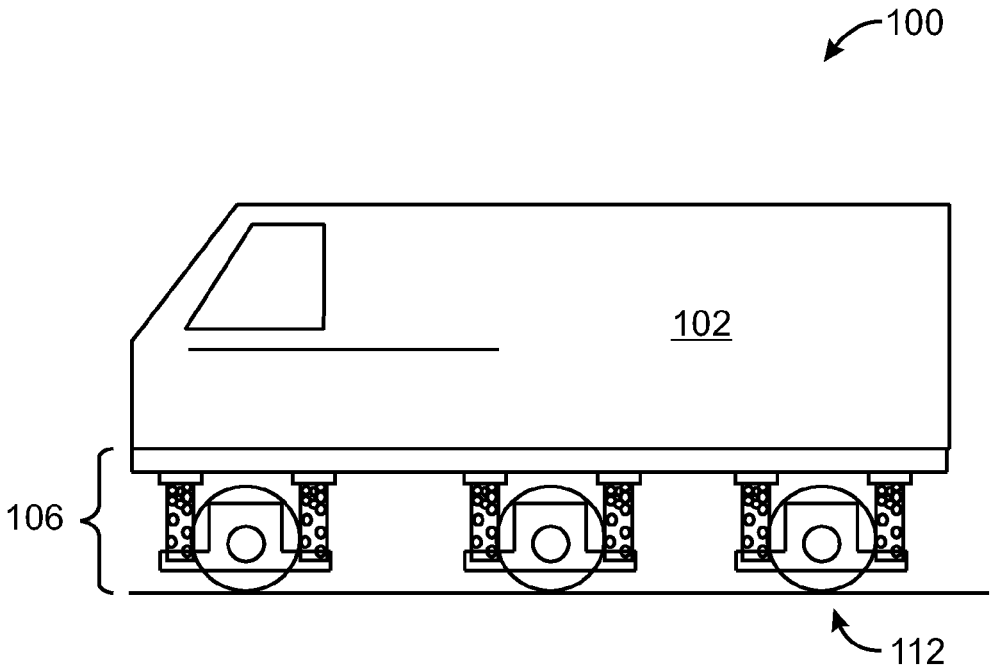
FIG. 1A is a block diagram of a rail vehicle (e.g., locomotive) assembled according to an exemplary embodiment of the invention.

FIG. 1A is a block diagram of a locomotive or other rail vehicle 100 assembled according to an exemplary embodiment of the invention. The locomotive or other rail vehicle 100 shown in FIG. 1A comprises a superstructure 102 and a rail vehicle truck 106. The superstructure 102 may be the body of the locomotive or other rail vehicle 100. The rail vehicle truck 106 may include the motor combos 112 that transport the locomotive or other rail vehicle 100 along rails.

Figure 1B:
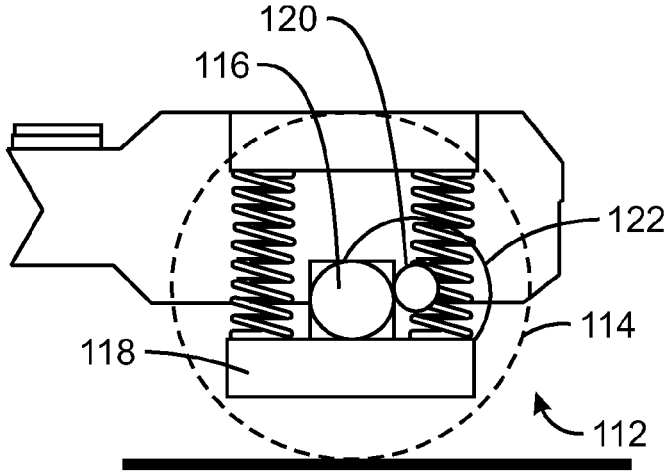
FIG. 1B is a schematic diagram of a motor combo according to an exemplary embodiment of the invention.

FIG. 1B is a schematic diagram of a motor combo according to an exemplary embodiment of the invention. Each motor combo 112 typically includes two train wheels 114, an axle 116 connecting the wheels 114, two J-boxes 118, a bull gear 120, and a traction motor 122. The J-boxes 118 contain a roller bearing for the axle. In a more general sense, each motor combo 112 is a device or assembly (disposed or to be disposed in a rail vehicle truck) that includes a traction motor 122 and some or all of the equipment (e.g., axle 116, wheels 114) used for interfacing the motor 122 with the rails on which the vehicle travels, for moving the vehicle along the rails.

Figure 2A:
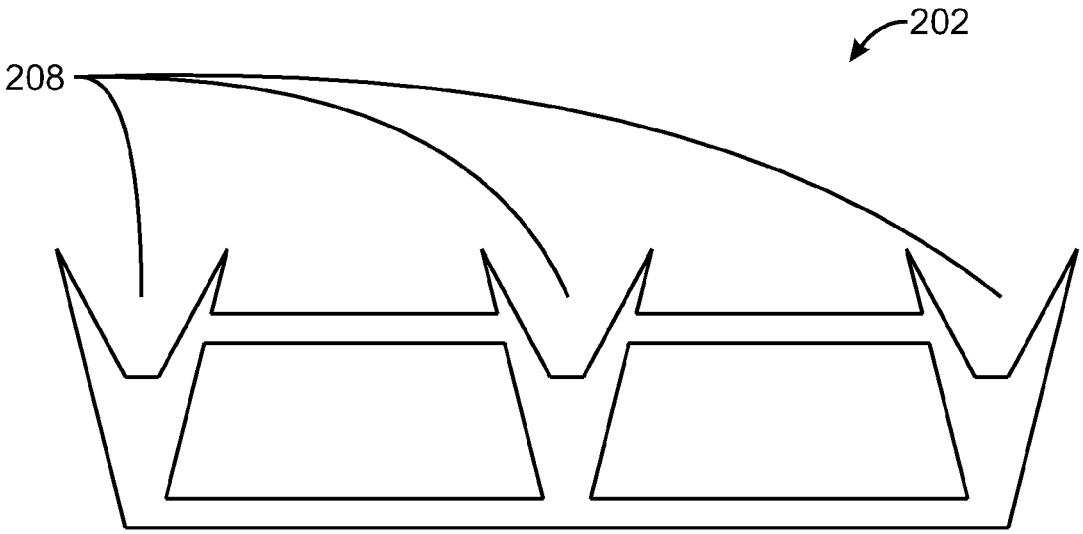
FIG. 2A is a side view of a fixture frame employed in the assembly of a rail vehicle truck, according to an exemplary embodiment of the invention.

In one embodiment of the invention, the rail vehicle truck 106 may be assembled on a fixture frame 202. FIG. 2A illustrates a side view of a fixture frame 202 employed in the assembly of the rail vehicle truck 106, according to an exemplary embodiment of the invention. The motor combos 112 may be placed within the fixture frame 202, along with a plurality of springs (which are part of the truck for vehicle suspension), for assembly of the rail vehicle truck 106.

The fixture frame 202 may be supported on the floor or another work support surface (e.g., a horizontal surface capable of supporting thousands of lbs/kg), and may include v-spaces 208 for positioning the wheels 114 of the motor combos 112. The v-spaces 208 may include structure for supporting the wheels 114. The fixture frame 202 may also include J-box supports, which are illustrated in FIG. 2B.

Figure 2B:
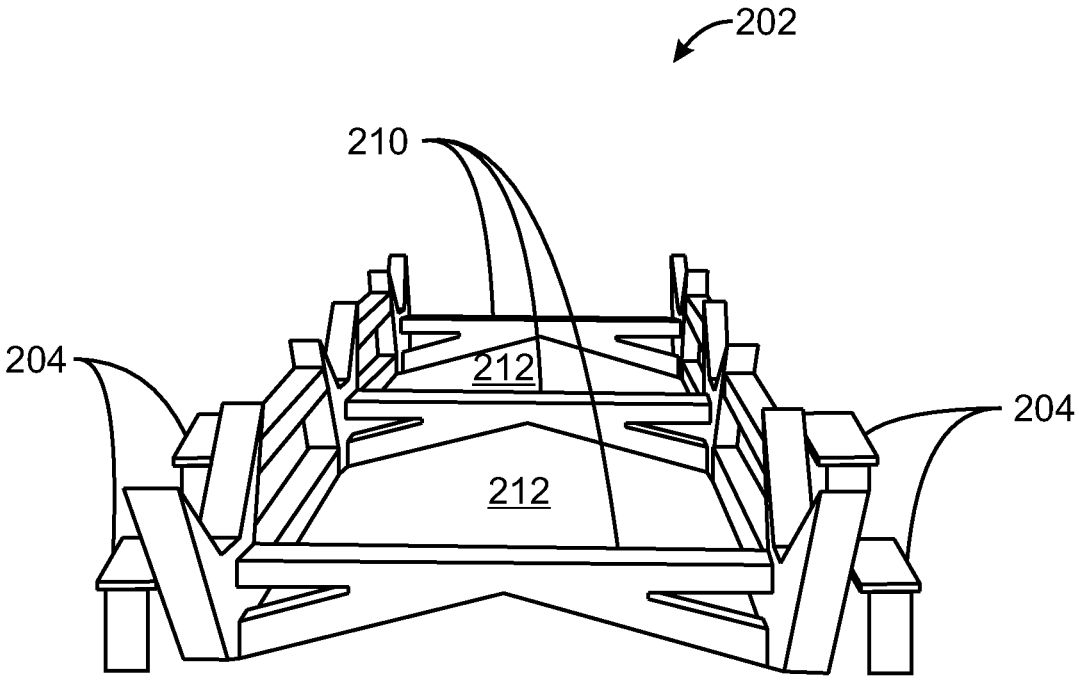
FIG. 2B is a front view of the fixture frame shown in FIG. 1, according to an exemplary embodiment of the invention.

FIG. 2B is a front view of the fixture frame 202, according to an exemplary embodiment of the invention. The fixture frame 202 may include J-box supports 204, cross-bars 210, with openings 212. A motor combo lifter, described with reference to FIGS. 5 and 6, may be positioned within the openings 212.

The J-box supports 204 may be structures for supporting the J-boxes. The cross-bars 210 may be structures for supporting the traction motors 122. During assembly of the rail vehicle truck 106, the traction motors 122 may rest upon the cross-bars 210, and the J-boxes 118 may rest upon the J-box supports 204.

While the fixture frame 202 illustrated is configured for a rail vehicle truck 106 with three motor combos 112, other configurations are possible. For rail vehicle trucks 106 with two or four (or other) axle arrangements, a fixture frame 202 accommodating two or four (or other) motor combos may be employed, respectively.

Figure 3:
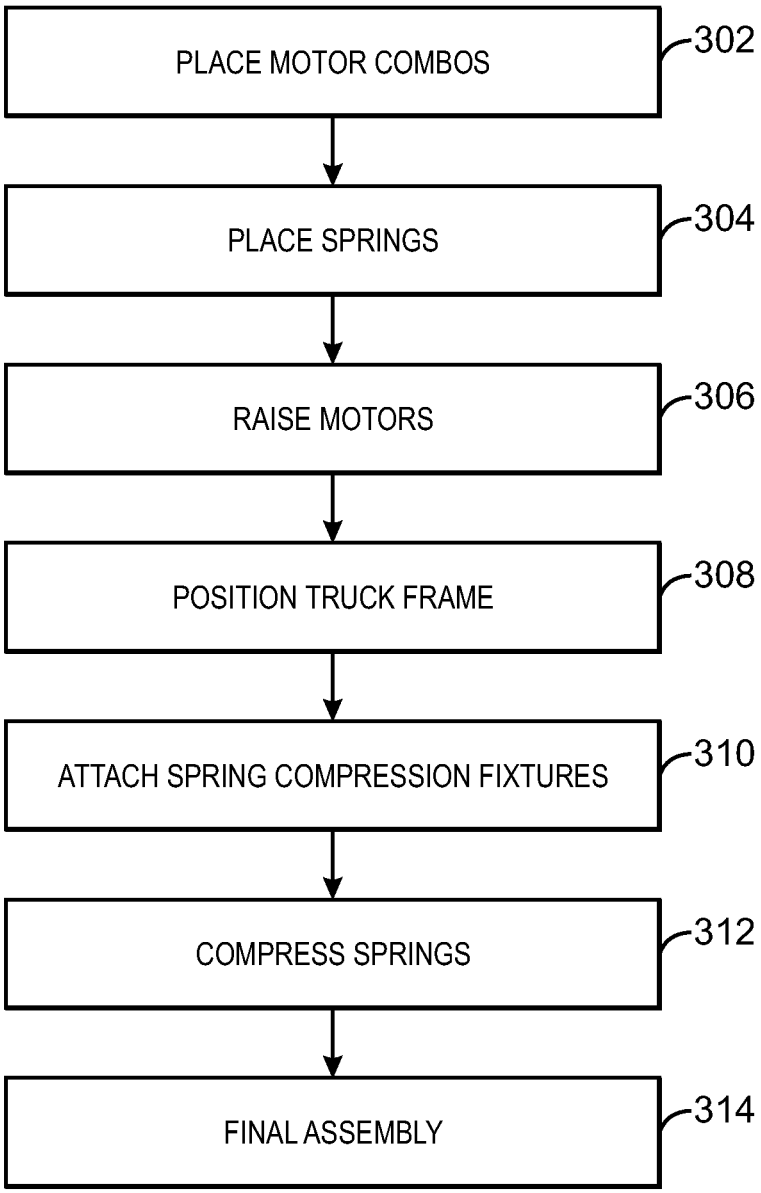
FIG. 3 is a process flow diagram showing a method of assembling a rail vehicle truck, according to an exemplary embodiment of the invention.

FIG. 3 is a process flow diagram showing a method of assembling the rail vehicle truck 106, according to an exemplary embodiment of the invention. The method is referred to by the reference number 300. The method 300 is described with reference to FIGS. 4A-4F, which are block diagrams of the rail vehicle truck 106 in different stages of assembly, according to an exemplary embodiment of the invention.

Figure 4A:
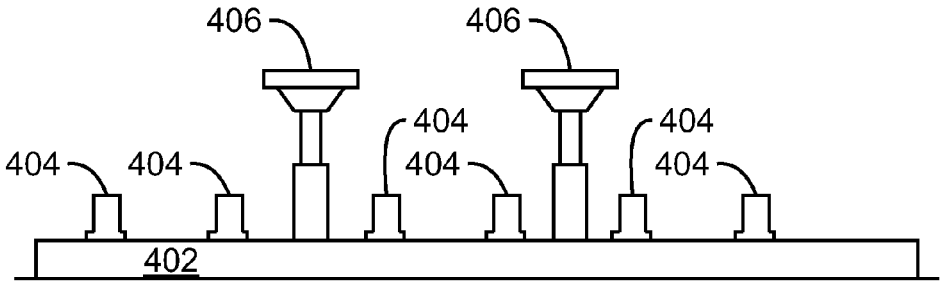
FIGS. 4A-4F are block diagrams of a rail vehicle truck in different stages of assembly, according to an exemplary embodiment of the invention.

FIG. 4A is an illustration of a fixture frame 402, which includes J-box supports 404, as discussed above. For clarity, the structures of the fixture frame 402 forming the v-spaces 208 are not shown in FIG. 4A.

In one embodiment of the invention, the fixture frame 402 includes a spring compression fixture 406, which may be attached within the fixture frame 402. The spring compression fixture 406 is used to compress the springs that are placed on the fixture frame 402 at a different stage in the method 300. In an embodiment, there are plural spring compression fixtures 406.

Figure 4B:
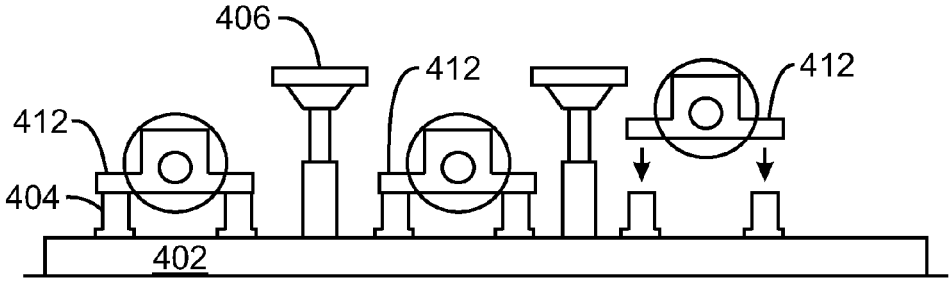

At block 302, three motor combos 412 are placed on the fixture frame 402. The motor combos 412 may be lowered onto the fixture frame 402 using winches. The placement of the motor combos is illustrated in FIG. 4B. As stated previously, the wheels of the motor combos 412 occupy the v-spaces 208. The J-boxes of the motor combos are supported by the J-box supports 404. (As should be appreciated, as supported by the fixture frame 402, the motor combos are "right side up," meaning oriented the same as when the truck is in use on a rail vehicle.)

Figure 4C:
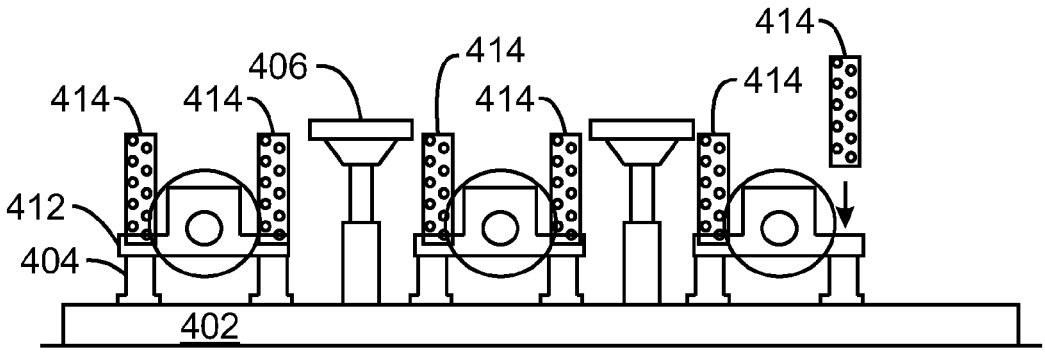

At block 304, the springs 414 are placed on the motor combos 412. The placement of the springs 414 is illustrated in FIG. 4C. The motor combos (e.g., the J-boxes) may include recesses or other features for receiving the springs.

At block 306, the motors of the motor combos may be raised. The truck frame 416, illustrated in FIG. 4D in schematic/simplified form, interconnects with the noses of the motors. As such, the motors may be simultaneously raised to facilitate the interconnection. A motor combo lifter 600, described with reference to FIGS. 5-6, may be used to simultaneously raise the motors of the motor combos 412. The motor combo lifter 600 may, by raising the motors, rotate the motors along the axle, thereby positioning the motor noses to interconnect with truck frame 416.

With some types of motor combos and rail vehicle trucks, it may not be necessary to raise the motors. Accordingly, the step of block 306 is optional, depending on whether such an operation is needed to facilitate interconnection of the truck frame to the motor combos.

Figure 4D:
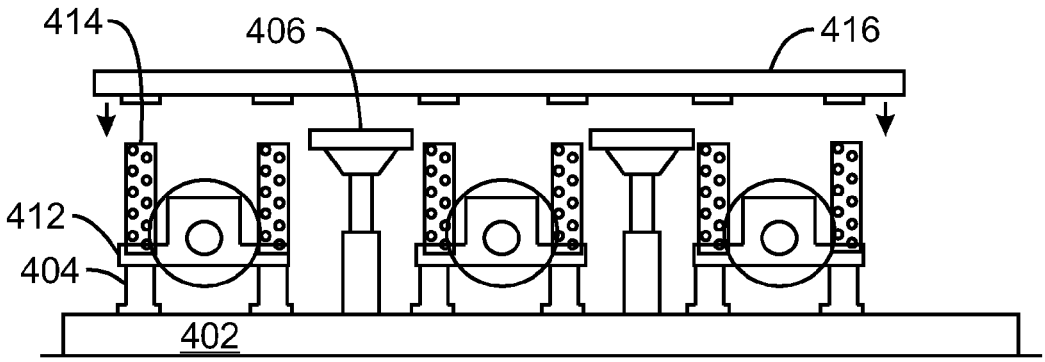

At block 308, the truck frame 416 is positioned to drop and engage with the motor noses and springs, or otherwise with the motor combos. The positioning of the truck frame 416 is illustrated in FIG. 4D.

Figure 4E:
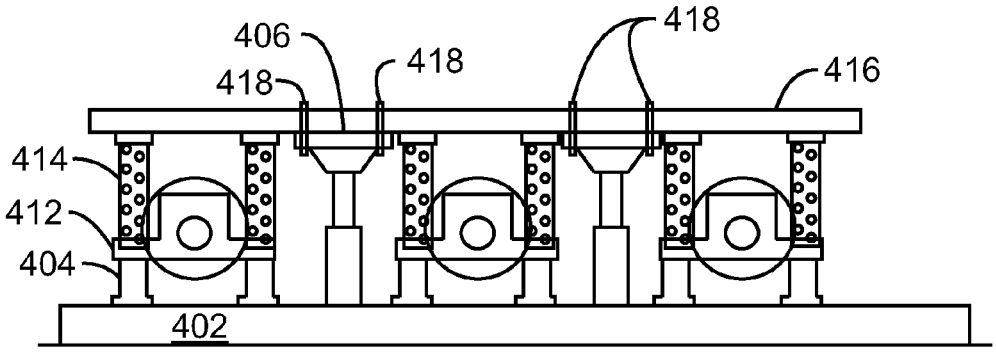

At block 310, the spring compression fixtures 406 are attached to the truck frame 416. FIG. 4E illustrates the spring compression fixtures 406 secured with bolts 418, or other temporary connection, to the truck frame 416.

Figure 4F:
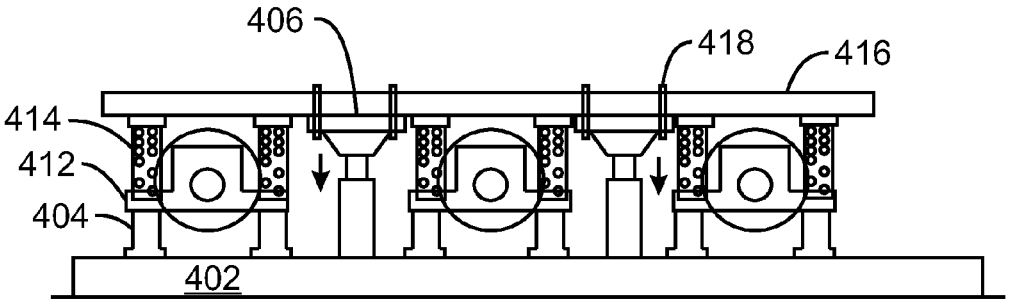

At block 312, the springs 414 are compressed by controlling the spring compression fixtures to move the truck frame 416 towards the fixture frame 402. As the truck frame 416 is moved towards the fixture frame 402, the springs, sandwiched between the truck frame and J-boxes (and J-box supports 404), are caused to compress. A hydraulic cylinder or other actuation device within the spring compression fixture 406 may be actuated to compress the springs. FIG. 4F illustrates the assembly with the springs 414 compressed.

At block 314, final assembly is performed. The motor combos 412 may be secured to the truck frame 416 with retention block installation fixtures (not shown), which retain the motor combos in place with the truck frame but allow for relative movement between the truck frame and motor combos as a vehicle suspension. Additionally, the spring compression fixtures may be removed.

Advantageously, the rail vehicle truck 406 illustrated in FIG. 4F is assembled upright. Further assembly of the locomotive 100 can continue without the dangerous step of flipping the rail vehicle truck 406 over.

Figure 5:
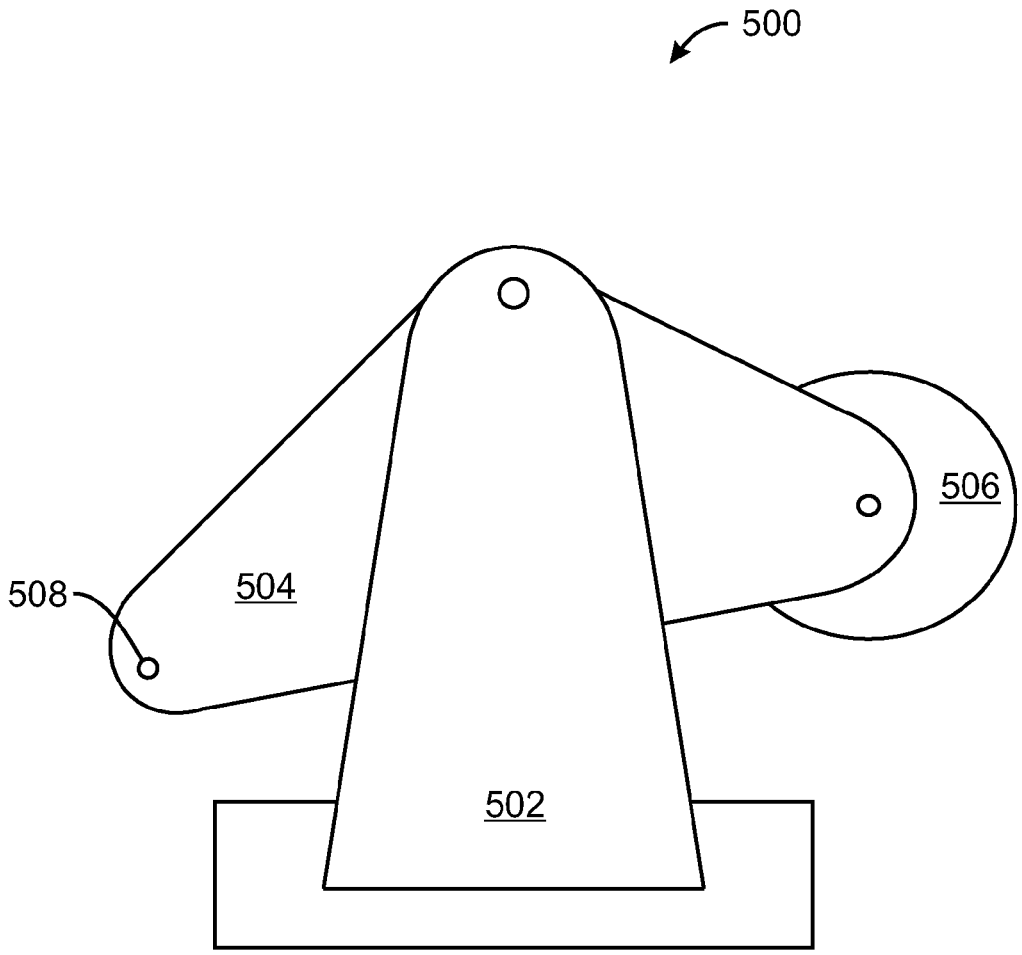
FIG. 5 is a block diagrams of a motor combo lifter employed in the assembly of a rail vehicle truck, according to an exemplary embodiment of the invention.

In an embodiment, a motor combo lifter 600 is provided for lifting the motors of the motor combos for facilitating connection of the truck frame 416 with the motors or motor combos. FIG. 5 is a block diagram of one segment 500 of the motor combo lifter 600, according to an exemplary embodiment of the invention. The segment 500 includes a base 502, a lifting arm 504, a wheel 506, and a connection 508.

The segment 500 may be positioned beneath a motor of one of the motor combos 412. A connecting rod (not shown in FIG. 5, but see element 602 in FIG. 6) is attached at the connection point 508. By moving the connecting rod in a horizontal direction, the lifting arm 504 rotates on its axis. The wheel 506 then engages and lifts the motor.

Figure 6A:
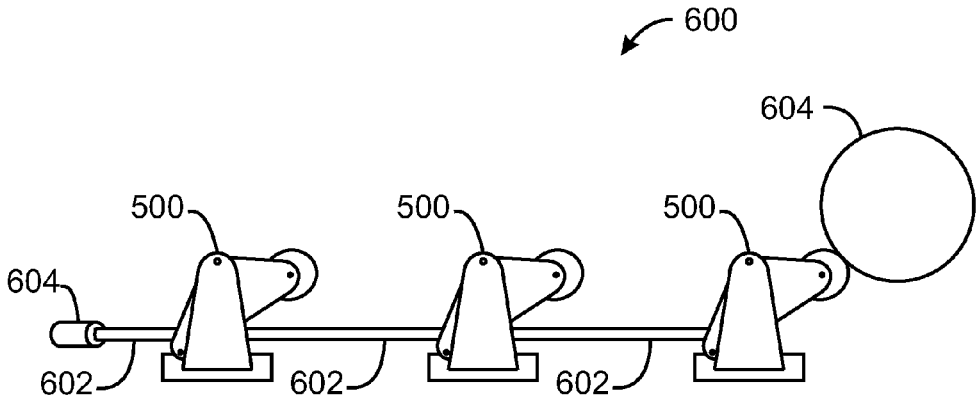
FIG. 6A is a block diagram of a motor combo lifter employed in the assembly of a rail vehicle truck, according to an exemplary embodiment of the invention.

FIG. 6A is a block diagram of the motor combo lifter 600 employed in the assembly of the rail vehicle truck 106, according to an exemplary embodiment of the invention. The motor combo lifter 600 may include a hydraulic cylinder 604 (or other actuating device), and a connecting rod 602 that connects to each of multiple lifting segments 500.

While three segments are illustrated in FIG. 6A, it should be noted that other configurations are possible. For rail vehicle trucks with two or four axle arrangements (for example), a motor combo lifter with two or four segments may be employed, respectively.

In one embodiment of the invention, the motor combo lifter 600 is positioned within the fixture frame 402. Each of the segments 500 is positioned underneath a motor 604 of one of the motor combos 412. For clarity, only one motor 604 is illustrated in FIG. 6A.

Figure 6B:
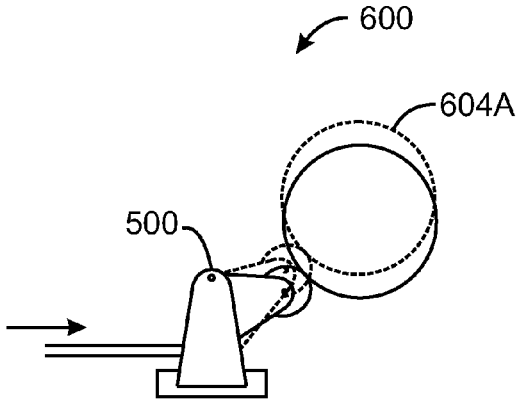
FIG. 6B is a block diagram of a motor combo lifter employed in the assembly of a rail vehicle truck, according to an exemplary embodiment of the invention.

FIG. 6B is a block diagram of a motor combo lifter employed in the assembly of a rail vehicle truck, according to an exemplary embodiment of the invention. By actuating the hydraulic cylinder 604, the connecting rod 602 moves horizontally, and rotates the lifting arms 504 of the segments 500. The lifting arms 504 then simultaneously raise the noses of all the motors 604A so that the truck frame 416 may be dropped and engaged as described with reference to FIG. 3.

Advantageously, by using the wheel 506 as the point of contact with the motors, different models of motors may be assembled within a single rail vehicle truck 106, and/or the fixture frame device may be used to assemble different types of trucks having different motor types.

Figure 7:
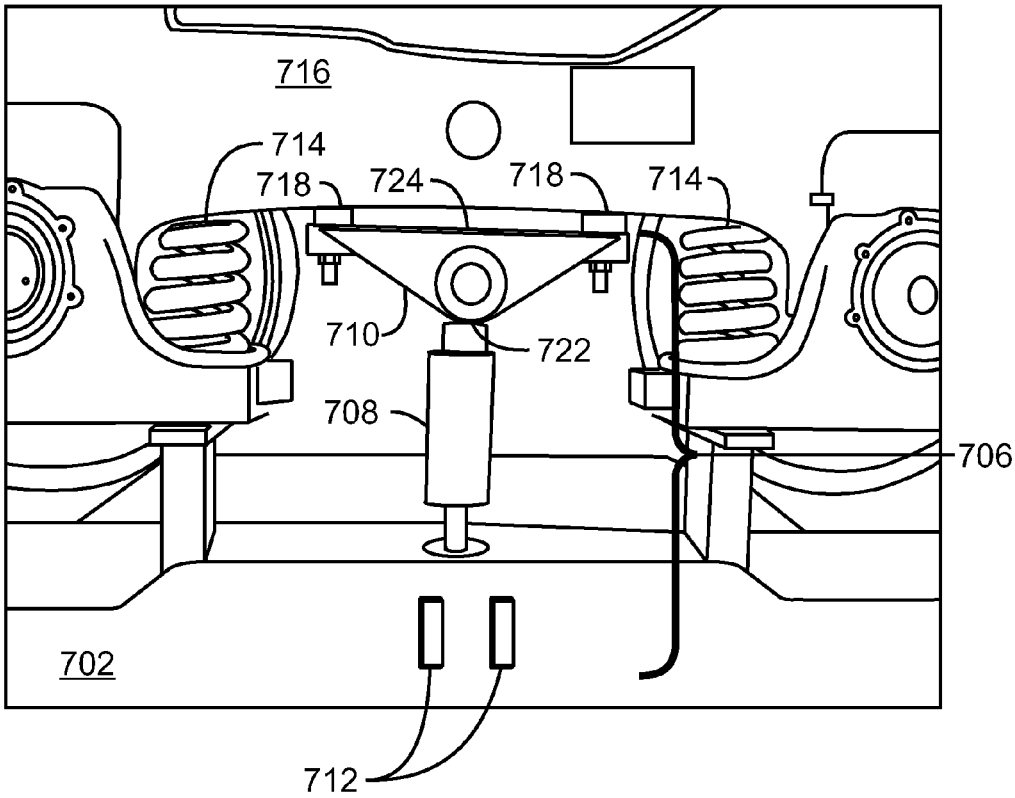
FIG. 7 is a block diagram of a spring compression fixture, according to an exemplary embodiment of the invention.

FIG. 7 is a block diagram of a spring compression fixture 706, according to an exemplary embodiment of the invention. The spring compression fixture 706 includes a hydraulic cylinder 708 (or other actuating device) and a top portion 710 that can be removably/temporarily attached to a truck frame 716. ("Actuating device" refers to a device that can be controlled to exert force for moving one object towards another. Examples include hydraulic cylinders, pneumatic cylinders, geared ratchet devices, screw jacks, and the like.)

The spring compression fixture 706 may be configured to withstand the pressure used to compress the springs 714. Additionally, the spring compression fixture may be configured to be attached to the fixture frame 702 with removable plates 712. When the hydraulic cylinder or other actuation device 708 is actuated, truck frame 716 is pulled towards the fixture frame 702, and the springs 714 compressed.

The top portion 710 may be configured to connect simply to the hydraulic cylinder 708 and the truck frame 716. In an exemplary embodiment of the invention, a point 722 of the top portion 710 may connect to the hydraulic cylinder or other actuation device 708. Additionally, a side 724 opposite the point 722 may attach to the truck frame 716 with bolts 718.

Figure 8A:
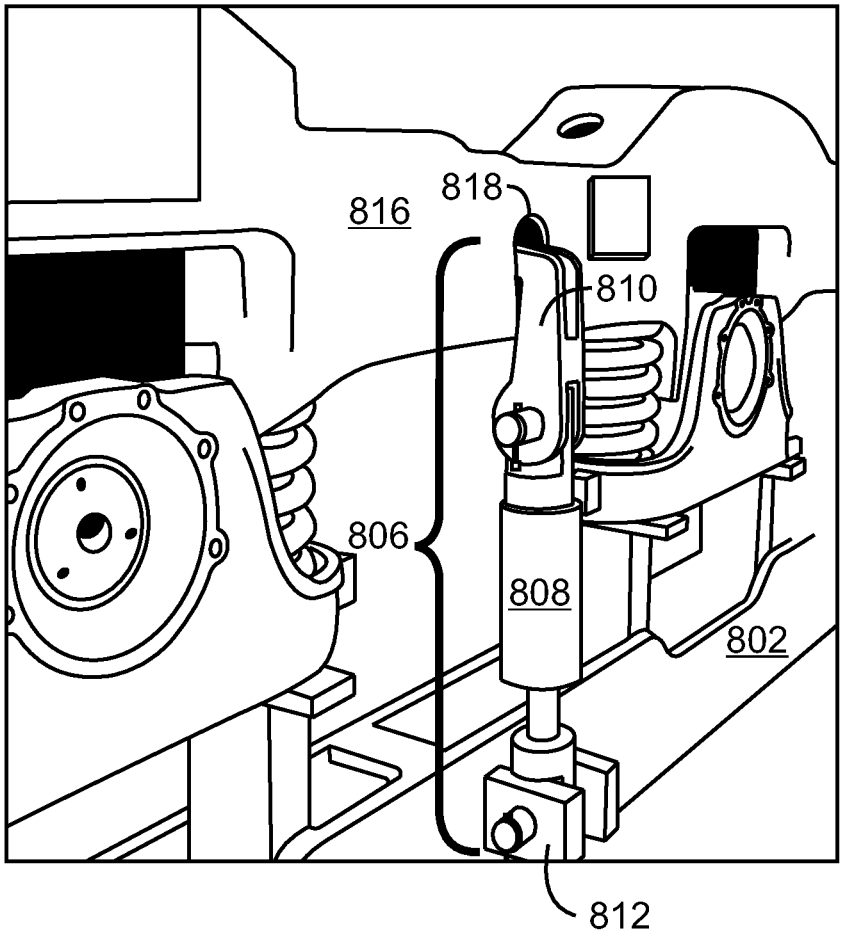
FIGS. 8A-8B are block diagrams of a spring compression fixture, according to an exemplary embodiment of the invention.
Figure 8B:
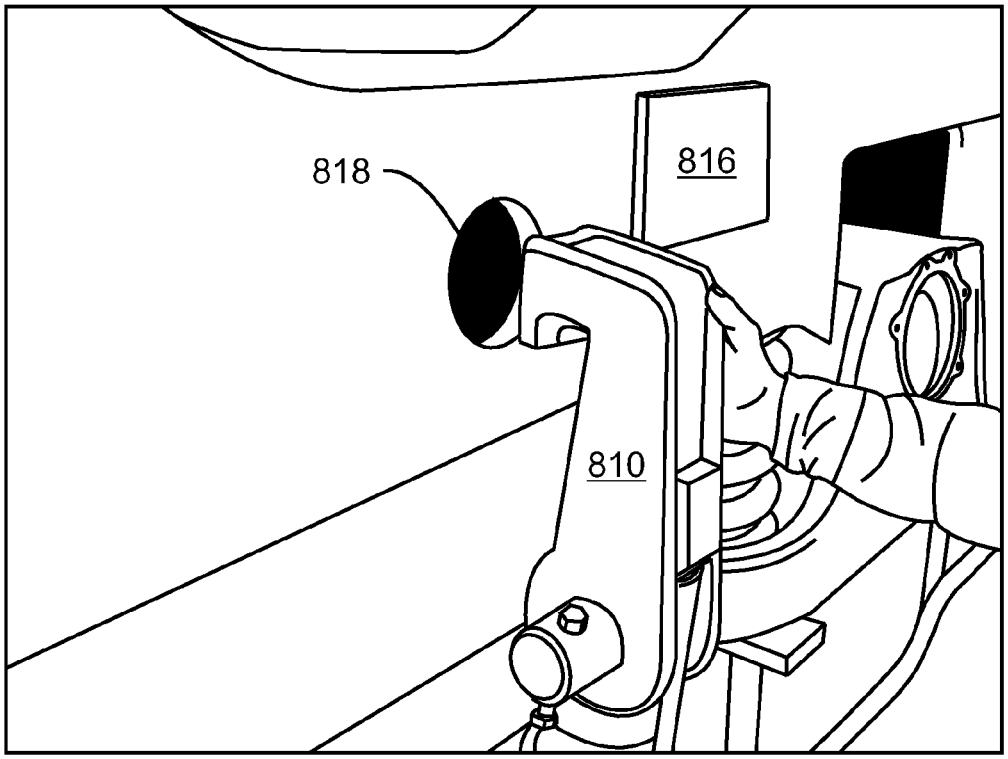

FIGS. 8A-8B are block diagrams of an alternative spring compression fixture 806, according to an exemplary embodiment of the invention. As stated previously, in one embodiment, the spring compression fixture 806 may not be attached until after all the components are assembled. In such an embodiment, the spring compression fixture 806 may be employed to compress springs 814.

The spring compression fixture 806 may also include a hydraulic cylinder 808 (or other actuation device) and a top portion 810 that can be removably attached to a truck frame 816.

The spring compression fixture 806 may also be attached to a fixture frame 802 with removable plates 812. In contrast to the spring compression fixture 706, the spring compression fixture 806 may be attached from outside the fixture frame 802 and the truck frame 816. As shown in FIG. 8A, the top portion 810 may be attached through a clearance hole 818 in the truck frame 816. As shown in FIG. 8B, the top portion 810 may comprise a hooked configuration for attaching at the clearance hole 818. Another embodiment relates to a device for an assembly of a rail vehicle. The device comprises a fixture frame 202, 401 and a plurality of spring compression fixtures 406, 706, 806 attached to the fixture frame. The fixture frame is supported on a work support surface, such as a floor. The fixture frame is configured to hold each of a plurality of motor combos 112 positioned for an assembly into a rail vehicle truck 106, with the motor combos being supported by the fixture frame offset from the work support surface. Each spring compression fixture 406, 706, 806 comprises an actuating device 708, 808 and a top portion 710, 810. The top portion is attached to the actuating device and adapted for attachment to a truck frame 416, 716, 816 interconnecting the motor combos. Actuation of the actuation devices of the plurality of spring compression fixtures causes the top portions to move towards the fixture frame. Since the truck frame is attached to the top portions, the truck frame moves towards the fixture frame for compressing a plurality of rail vehicle truck springs 414, 714 that are disposed between the motor combos and truck frame.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions, values, and types of materials described herein are intended to illustrate embodiments of the invention, they are by no means limiting and are exemplary in nature. Other embodiments may be apparent upon reviewing the above description. The scope of the invention should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," "third," "upper," "lower," "bottom," "top," "up," "down," etc. are used merely as labels, and are not intended to impose numerical or positional requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

As used herein, an element or step recited in the singular and proceeded with the word "a" or "an" should be understood as not excluding plural of said elements or steps, unless such exclusion is explicitly stated. Furthermore, references to "one embodiment" of the invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described system and method for assembling a rail vehicle, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A method for assembling a rail vehicle, comprising:

positioning a plurality of motor combos on a fixture frame, wherein the fixture frame is configured to hold each of the plurality of motor combos positioned for an assembly into a rail vehicle truck;

positioning a plurality of springs on each of the plurality of motor combos, wherein each of the plurality of springs is positioned for the assembly into the rail vehicle truck;

connecting a truck frame to the plurality of motor combos;

attaching a spring compression fixture, connected to the fixture frame, to the truck frame; and compressing, with the spring compression fixture, the plurality of springs for the assembly into the rail vehicle truck.

2. The method recited in claim 1, comprising securing the plurality of motor combos to the truck frame using a plurality of retention block installation fixtures.

3. The method recited in claim 1, comprising detaching the spring compression fixture from the truck frame, and completing construction of the rail vehicle, wherein the rail vehicle comprises the rail vehicle truck.

4. The method recited in claim 1, wherein the spring compression fixture comprises: a hydraulic cylinder connected to the fixture frame, wherein the hydraulic cylinder is adapted to apply a pressure sufficient to compress the springs for the assembly into the rail vehicle truck; and a top portion adapted to attach to: the truck frame; and the hydraulic cylinder.

5. The method recited in claim 4, wherein compressing the springs comprises actuating the hydraulic cylinder for moving the fixture frame and truck frame towards one another.

6. The method recited in claim 4, wherein the top portion is a triangle structure, wherein the top portion attaches to the hydraulic cylinder at a point of the triangle, and wherein the top portion attaches to the truck frame at a side of the triangle opposite the point.

7. The method recited in claim 4, wherein the top portion is a hook structure, wherein the top portion attaches to the truck frame by hooking the top portion through a clearance hole of the truck frame.

8. The method of claim 1, further comprising lifting, simultaneously, a plurality of motors corresponding to the plurality of motor combos such that the truck frame may be connected to the motors, wherein the step of connecting comprises connecting the truck frame to the plurality of motors.

9. The method recited in claim 8, wherein each of the motor combos comprises:

one of the corresponding plurality of motors;

two wheels;

an axle connecting the two wheels;

a bull gear that turns the axle; and a plurality of journal bearing housings, wherein each of the plurality of journal bearing housings comprises a roller bearing for the axle.

10. The method recited in claim 9, wherein the fixture frame is adapted to:

position each of the plurality of motor combos relative to others of the plurality of motor combos for the assembly into the rail vehicle truck;

support each of the two wheels;

support each of the plurality of motors; and support each of the plurality of journal bearing housings.

11. The method recited in claim 8, wherein lifting, simultaneously, the plurality of motors comprises raising a plurality of noses corresponding to the plurality of motors.

12. The method recited in claim 11, wherein connecting the truck frame to the plurality of motors comprises connecting the truck frame to the plurality of noses of the motors.

13. The method recited in claim 8, comprising positioning a combo lifter beneath the plurality of motor combos, wherein the combo lifter performs the lifting, simultaneously, of the plurality of motors.

14. The method recited in claim 13, wherein the fixture frame is adapted to accommodate the positioning of the combo lifter beneath the plurality of motor combos.

15. The method recited in claim 13, wherein the combo lifter comprises:

a plurality of segments, each segment comprising:

a base;

a lifter arm; and a connector;

a connecting rod that connects the plurality of segments at the connectors; and a hydraulic cylinder or other actuation device adapted to move the connecting rod, wherein moving the connecting rod simultaneously moves the lifter arms, wherein the lifter arms simultaneously lift the plurality of motors.

* * * * *